United States Patent [19]

Lash

[11] 4,129,482

[45] Dec. 12, 1978

[54] ELECTROPLATING IRON GROUP METAL ALLOYS

[75] Inventor: Ronald J. Lash, Warren, Mich.

[73] Assignee: M&T Chemicals Inc., Stamford, Conn.

[21] Appl. No.: 809,558

[22] Filed: Jun. 24, 1977

[51] Int. Cl.[2] ..... C25D 3/56

[52] U.S. Cl. ..... 204/43 T

[58] Field of Search ..... 204/43 T, 48, 49, 112, 204/123

[56] References Cited

U.S. PATENT DOCUMENTS

| | | | |
|---|---|---|---|
| 3,969,198 | 7/1976 | Law et al. | 204/43 T |
| 3,974,044 | 8/1976 | Tremmel | 204/43 T |
| 4,036,709 | 7/1977 | Harbulak | 204/43 T |
| 4,046,647 | 9/1977 | Harbulak | 204/43 T |

FOREIGN PATENT DOCUMENTS

| | | | |
|---|---|---|---|
| 238982 | 7/1969 | U.S.S.R. | 204/49 |

OTHER PUBLICATIONS

J. K. Dennis et al., "Nickel and Chromium Plating", p. 141, (1972).

*Primary Examiner*—G. L. Kaplan

*Attorney, Agent, or Firm*—Kenneth G. Wheeless; Robert Spector

[57] ABSTRACT

In accordance with certain of its aspects this invention relates to a process and composition for the preparation of an electrodeposit which contains iron; at least one metal selected from the group consisting of nickel and cobalt or; binary or ternary alloys of iron and of the metals selected from nickel and cobalt; which comprises passing current from an anode to a cathode through an aqueous acidic electroplating solution containing iron and at least one member selected from the group consisting of nickel compounds and cobalt compounds providing nickel, cobalt and iron ions for electrodepositing nickel-iron alloys, cobalt-iron alloys or nickel-iron-cobalt alloys, an effective amount of at least one additive; the improvement comprising the presence of at least one complexing compound consisting of a polysubstituted aryl compound containing at least one carboxylic acid group defined as —COOH, another substituent independently selected from hydroxy or carboxy, and one or more substituents independently selected from sulfo, defined $—SO_3H$, or sulfoalkyl groups.

14 Claims, No Drawings

ELECTROPLATING IRON GROUP METAL ALLOYS

DESCRIPTION OF THE INVENTION

This invention relates to the electrodeposition of iron alloys of nickel and/or cobalt using an improved process and composition by passing a current from an anode to a cathode through an acidic aqueous plating solution which contains at least one iron compound and nickel or cobalt or nickel and cobalt compounds to provide nickel, cobalt and iron ions for electrodepositing alloys of nickel-iron or cobalt-iron or nickel-cobalt-iron. Such alloys are comparable to 100 percent nickel deposits in brightness, leveling and corrosion properties and are a satisfactory substrate for chromium deposition.

It is known in the art of nickel-iron electroplating that the presence of excessive amounts of trivalent iron, which easily forms especially in air agitated baths, tends to produce deposits with unsightly adverse qualities by precipitating basic iron salts in the cathode film as well as in the bulk of the solution. In order to reduce the iron (III) activity in the plating solution and to prevent such problems, nickel-iron plating solutions heretofore contain an iron complexing agent in the form of hydroxy substituted lower aliphatic carboxylic acids having from 2–8 carbon atoms such as citric acid described by Brown (U.S. Pat. No. 2,800,440) and Clauss et al. (U.S. Pat. No. 3,806,429); gluconic acid, glucoheptonate, glycollic acid and the like are used by Clauss and Tremmel (U.S. Pat. No. 3,795,591). Others attempt to reduce the trivalent iron to the divalent state; Tremmel employs a reducing saccharide (U.S. Pat. No. 3,974,044) and Koretzky (U.S. Pat. No. 3,354,059) utilizes ascorbic or isoascorbic acid. However these compounds can reduce leveling and undergo decomposition which results in the formation of insoluble degradation salts with nickel ions. These products precipitate from the plating solution and collect on the anode bags and on the filter causing them to become clogged; this produces anode polarization problems and filter stoppages. Since these complexing and reducing agents are counter-leveling, more metal is required on poorly buffed or unbuffed basis metals which results in longer plating times and increased costs. Less complexing agents could be used if conditions which favor less ferric ion formation could be implemented, such as operating the plating bath at a lower pH. However, lower pH values reduce leveling even further in these baths, only adding to the dilemma.

It is therefore the purpose of this invention to provide a method and composition for the electrodeposition of bright nickel-iron or cobalt-iron alloys of higher iron content, generally on the order of 15 to 70 percent iron, and with greater leveling at lower pH and free from formation of insoluble degradation salts with nickel ions and free from the precipitation of basic iron salts.

Such deposits are suitable substrates for the electrodeposition of decorative or functional chromium, which increases the corrosion resistance of the basis metal such as steel with or without an initial layer of electrodeposited semi-bright nickel, copper or the like.

The aqueous plating solution described in this invention contains soluble iron compounds to provide iron ions, soluble nickel compounds to provide nickel ions and/or soluble cobalt compounds to provide cobalt ions. Although the highest percentage of total iron in the bath is in the preferred divalent state, the solution also contains an amount of ferric ion due to air and/or anodic oxidation of iron (II). The electrolyte also contains an aromatic complexing agent of the type described below, to provide a water soluble trivalent iron complex, which may or may not be used in combination with iron (III) reducing compounds such as sulfites or bisulfites, ascorbic or isoascorbic acid, reducing saccharides, iron metal, etc. The bath may also contain suitable nickel or nickel-iron additives such as the sulfo-oxygen compounds including aromatic sulfonates, sulfonamides, sulfonimides, sulfinates as well as aliphatic or aromatic-aliphatic olefinically or acetylenically unsaturated sulfonates, sulfonamides, or sulfonamides. Acetylenic, heterocyclic nitrogen, nitrile, dyestuffs, etc., nickel brighteners may also be used in cooperation with sulfo-oxygen compounds.

The complexing agent which is utilized in this invention consists of a poly-substituted aryl compound containing at least one carboxylic acid group defined as —COOH, another substituent independently selected from hydroxy or carboxy, and one or more substituents independently selected from sulfo, defined —$SO_3H$, or sulfoalkyl groups. Complexing compounds typical of those described in this invention are of the formula:

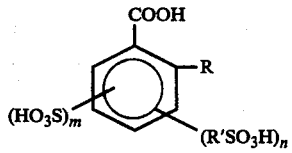

Where R is independently hydroxy or carboxy, R′ is an alkyl group of 1–8 carbon atoms, and n and m are independently integers 0, 1 or 2 and the sum of n+m is greater than zero, and where the aromatic ring may additionally be polycyclic. The carboxy or sulfonate group may be the free acid or a water soluble salt thereof such as with the alkali metals etc. It is also understood that any other bath inert substituents such as halogens, alkoxy groups etc. may also be present.

Typical compounds covered by the above generalized structure may include:

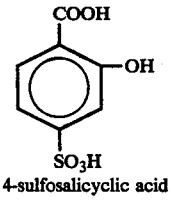

4-sulfosalicyclic acid

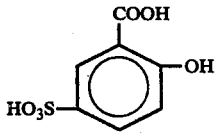

5-sulfosalicylic acid

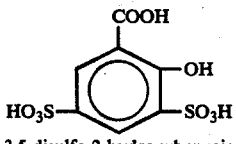

3,5-disulfo-2-hydroxybenzoic acid

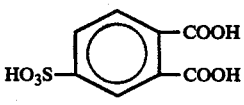

sulfophthalic acid

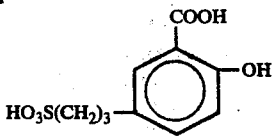

5-(3-sulfopropyl)-2-hydroxybenzoic acid

Especially useful compounds include 4-sulfosalicylic acid, 5-sulfosalicylic acid and sulfophthalic acid.

OPERATION OF THE INVENTION

In order to deposit iron alloys of nickel or cobalt according to the various aspects of this invention, a bath is prepared containing nickel salts such as nickel sulfate and/or nickel chloride which are usually present in the concentration range of 50 to 300 grams per liter and 100 to 275 grams per liter respectively. The iron may be introduced into the bath from the chemical or electrochemical oxidation of the iron anodes or it may be introduced in the form of ferrous sulfate or ferrous chloride; the ferrous salts are normally employed at a concentration of about 5 to 100 grams per liter. Although the greatest percentage of the total iron in the bath is in the preferred divalent state, trivalent iron is also present due to air or anodic oxidation of iron (II). The trivalent iron may be present in the bath from a few parts per million to about 5 grams per liter but preferably less than one gram per liter. This invention may also include a nickel bath containing ferric iron as an impurity.

Complexing compounds typical of those described in this invention are sulfosalicylic acid and sulfophthalic acid which are utilized in amounts from 1 to 100 grams per liter. It is understood that water soluble salts of these compounds such as ammonium and alkali metal salts may also be used.

The function of the complexing agent is to keep the everforming pernicious ferric ions coordinated in solution thereby allowing them to be harmlessly reduced at the cathode surface or by chemical reducing agents such as bisulfites or formaldehyde adducts thereof, isoascorbic acid, reducing saccharides, iron metal etc. The complex described in this invention may be used alone or in combination with much less described reducing agents and prior art complexing agents, e.g. gluconate which all act to reduce leveling. The novel and unexpected aspects of this invention are:

1. The complex is not counter-leveling but actually appears synergistic with acetylenic levelers.
2. The complex allows operation below pH 3.0 (lower pH values inhibit the formation of ferric ions) without a reduction in leveling as observed with other systems.
3. The complex does not degrade with electrolysis to insoluble products which precipitate and clog anode bags and filters and produce rough deposits.

Thus, the complexing agents of this invention promote the electrodeposition of an alloy of higher iron content with increased brightness and leveling. Deposits have low stress, excellent ductility and superb chromium receptivity.

The concentration of the complexing agent in the bath may range from 1 to 100 grams per liter with a preferred concentration range of about 5 to 15 grams per liter. Nickel or nickel-iron brightening additives may additionally be utilized to further promote luster, ductility and leveling in the deposits.

Suitable nickel additives that have been found effective are the sulfo-oxygen compounds including aromatic sulfonates, sulfonamides, sulfonimides, sulfinates, as well as aliphatic or aromatic-aliphatic olefinically or acetylenically unsaturated sulfonates, sulfonamides or sulfonimides. Such compounds may be used singly or in combination and can be employed in the present invention from 0.5 to 10 grams per liter.

For bright, well-leveled alloy plating, acetylenic nickel brighteners may also be used in cooperation with a sulfo-oxygen compound. Suitable compounds are diethoxylated 2-butyne-1,4-diol, dipropoxylated 2-butyne-1,4-diol or those described in U.S. Pat. No. 3,922,209.

Various buffers may also be used in the bath such as boric acid, sodium acetate, citric acid, sorbitol, etc. The concentration may range from 20 grams per liter to saturation; preferably, about 45 grams per liter.

Wetting agents may be added to the electroplating baths of this invention to reduce the surface tension of the solution and to reduce pitting. These organic materials with surfactant properties also function to make the baths more compatible with contaminants such as oil, grease, etc. by their emulsifying, dispersing, and solubilizing action on such contaminants and thereby promote attaining of sounder deposits.

The pH of all the foregoing illustrative aqueous iron-nickel containing, cobalt-iron containing and nickel-cobalt-iron containing compositions may be maintained during plating at pH values of 2.0 to 5.0 and preferably from 2.5 to 3.0 During bath operation, the pH may normally tend to rise and may be adjusted with acids such as hydrochloric acid or sulfuric acid, etc.

Agitation of the above baths during plating may consist of solution pumping, moving cathode rod, air agitation or combinations thereof.

Anodes used in the above baths may consist of the particular single metals being plated at the cathode such as iron and nickel, for plating nickel-iron, cobalt and iron, for plating cobalt-iron, or nickel, cobalt, and iron, for plating nickel-cobalt-iron alloys. The anodes may consist of the separate metals involved suitably suspended in the bath as bars, strips or as small chunks in titanium baskets. In such cases the ratio of the separate metal anode area is adjusted to correspond to the particular cathode alloy composition desired. For plating binary or ternary alloys one may also use as anodes alloys of the metals involved in such a percent weight ratio of the separate metals as to correspond to the percent weight ratio of the same metals in the cathode alloy deposits desired. These two types of anode systems will generally result in a fairly constant bath metal ion concentration for the respective metals. If with fixed metal ratio alloy anodes there does occur some bath metal ion imbalance, occasional adjustments may be made by adding the appropriate corrective concentration of the individual metal salts. All anodes or anode baskets are usually suitably covered with cloth or plastic bags of desired porosity to minimize introduction into the bath of metal particles, anode slime, etc. which may migrate to the cathode either mechanically or electrophoretically to give roughness in cathode deposits.

The substrates on which the nickel-iron, cobalt-iron or nickel-cobalt-iron containing electrodeposits of this invention may be applied may be metal or metal alloys such as are commonly electrodeposited and used in the art of electroplating such as nickel, cobalt, nickel-cobalt, copper, tin, brass, etc. Other typical substrate basis metals from which articles to be plated are manufactured may include ferrous metals such as steel; copper; alloys of copper such as brass, bronze, etc.; zinc, particularly in the form of zinc-base die castings; all of which may bear plates of other metals, such as copper, etc. Basis metal substrates may have a variety of surface finishes depending on the final appearance desired, which in turn depends on such factors as luster, brilliance, leveling, thickness, etc. of the nickel-iron, cobalt-iron and nickel-cobalt-iron containing electroplate applied on such substrates.

The operating temperature of the bath may range from about 30° C. to 70° C., preferably 50° C. to 60° C.

The average cathode current density may range from about 0.5 to 20 ampere per square decimeter, preferably about 4 ampere per square decimeter.

The following examples are submitted to further the understanding of the operation of the invention and are not to be construed as limiting its scope.

EXAMPLE I

A nickel-iron bath was prepared having the following composition:

| | |
|---|---|
| $NiSO_4 \cdot 6H_2O$ | 130 g/l |
| $NiCl_2 \cdot 6H_2O$ | 90 g/l |
| $FeSO_4 \cdot 7H_2O$ | 52 g/l |
| $H_3BO_3$ | 49 g/l |
| Sodium gluconate | 20 g/l |
| Sodium saccharinate | 3.5 g/l |
| Sodium allyl sulfonate | 3.5 g/l |
| 1,4-Di-(β-hydroxyethoxy)-2-butyne | 0.05–0.1 g/l |
| pH | 2.8 – 3.5 |
| Temperature | 54° C |
| Air Agitation | |

Both brass and steel test panels were used on which a band was scribed with a single pass of 4/0 grit emery. The panels were plated in a 267 ml. Hull Cell at 2 amperes for 10 minutes. The resulting deposits from this solution were bright but had poor ductility and were dark in the low current density region. The leveling, although fair at pH 3.5, became almost non-existent at pH 2.8. The iron content in the deposit was found by analysis to be 44 percent iron.

EXAMPLE II

The tests of Example I were repeated using 5 grams per liter of sulfosalicylic acid as the complexing agent for iron (III) in place of the sodium gluconate. The resulting deposits were fully bright, had excellent ductility and possessed exceptionally good leveling even at pH 2.5. The deposits were bright and clear in the low current density region and showed very good throwing power. Upon analysis, the deposit was found to contain 52 percent iron.

EXAMPLE III

A four liter nickel-iron bath was prepared having the following composition:

| | |
|---|---|
| $NiSO_4 \cdot 6H_2O$ | 100 g/l |
| $NiCl_2 \cdot 6H_2O$ | 95 g/l |
| $FeSO_4 \cdot 7H_2O$ | 40 g/l |
| $H_3BO_3$ | 49 g/l |
| Sodium gluconate | 25 g/l |
| Sodium saccharinate | 3.0 g/l |
| Sodium allyl sulfonate | 3.0 g/l |
| 1,4-Di-(β-hydroxyethoxy)-2-butyne | 0.05–0.1 g/l |
| pH | 3.5 |
| Temperature | 54° C |
| Air Agitation | |

Extended electrolysis of this solution over several hundred ampere-hours per gallon caused insoluble degradation products to be formed which precipitated as a nickel salt, much of which accumulated on the walls of the plating vessel, and on the anode bags. This resulted in anode polarization problems which only accelerated the degradation causing adverse effects on the deposit from free ferric ions. Adding more gluconate to complex the ferric ions reduced leveling and contributed to the formation of additional degradation products in the solution and on the anode bags. During plating, these degradation products can settle on the shelf areas of the cathode causing roughness.

EXAMPLE IV

The tests of Example III were repeated at pH 2.8 using 10 grams per liter of sulfosalicylic acid in place of sodium gluconate. Upon extended electrolysis over several hundred ampere-hours per gallon, there were no adverse effects on the deposit from ferric ions; there was no precipitation of basic ferric salts in the bath; there was no formation of insoluble degradation products; and there was no loss of leveling due to the complexing agent or the low operating pH of the bath. This test indicates greater stability and longer life for sulfosalicylic acid in the nickel-iron plating bath as opposed to the more ephemeral complexing agents used in the art to this time.

EXAMPLE V

A nickel-iron bath was prepared and analyzed with the following results:

| | |
|---|---|
| $NiSO_4 \cdot 6H_2O$ | 128 g/l |
| $NiCl_2 \cdot 6H_2O$ | 92 g/l |
| $Ni^{+2}$ | 51 g/l |
| $H_3BO_3$ | 49 g/l |
| Fe (Total) | 7.8 g/l |
| $Fe^{+3}$ | 0.20 g/l |
| Sodium saccharinate | 3.3 g/l |
| Sodium allyl sulfonate | 3.8 g/l |
| 1,4-Di-(β-hydroxyethoxy)-2-butyne | 0.08 g/l |
| pH | 2.7 |
| Temperature | 56° C |
| Air Agitation | |

After electrolyzing this solution in a Hull Cell for 30 minutes at a cell current of 2 amperes, it became very turbid from the formation of basic ferric salts even at this low pH.

EXAMPLE VI

The test of Example V was repeated with the following addition:

| | |
|---|---|
| Sulfosalicylic acid sodium salt | 6 g/l |
| pH | 2.7 |

After electrolysis in a Hull Cell for 60 minutes at a cell current of 2 amperes, the solution was clear and completely free of basic ferric salt precipitation.

Although this invention has been illustrated by reference to specific embodiments, modifications thereof which are clearly within the scope of the invention will be apparent to those skilled in the art.

What is claimed is:

1. A process for the preparation of an electrodeposit which contains from 15% to 70% iron; at least one metal selected from the group consisting of nickel and cobalt or; binary or ternary alloys of iron and of the metals selected from nickel and cobalt; which comprises passing current from an anode to a cathode through an aqueous acidic electroplating solution containing iron and at least one member selected from the group consisting of nickel compounds and cobalt compounds providing nickel, cobalt and iron ions for electrodepositing nickel-iron alloys, cobalt-iron alloys or nickel-iron-cobalt alloys; the improvement comprising the presence of 1 to 100 g/l of at least one complexing compound consisting of a poly-substituted aryl compound containing at least one carboxylic acid group defined as —COOH, another substituent independently selected from hydroxy or carboxy, and one or more substituents independently selected from sulfo, or sulfoalkyl groups.

2. The process of claim 1 wherein said complexing agent is 4-sulfosalicylic acid.

3. The process of claim 1 wherein said complexing agent is 5-sulfosalicylic acid.

4. The process of claim 1 wherein said complexing agent is 3,5-disulfo-2-hydroxybenzoic acid.

5. The process of claim 1 wherein said complexing agent is sulfophthalic acid.

6. The process of claim 1 wherein said complexing agent is 5-(3-sulfopropyl)-2-hydroxybenzoic acid.

7. A process for the preparation of an electrodeposit which contains; at least one metal selected from the group consisting of nickel and cobalt or; binary or ternary alloys of the metals selected from nickel, iron, and cobalt; which comprises passing current from an anode to a cathode through an aqueous acidic electroplating solution containing 5 to 100 grams per liter of iron compounds and at least one member selected from the group consisting of nickel compounds and cobalt compounds providing nickel, cobalt and iron ions for electrodepositing nickel-iron alloys, cobalt-iron alloys or nickel-iron-cobalt alloys and a complexing agent exhibiting the formula:

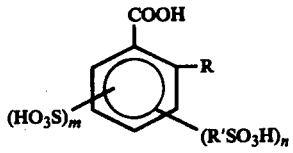

Where R is independently hydroxy or carboxy, R′ is an alkylene group of 1–8 carbon atoms, and n and m are independently integers 0, 1 or 2 and the sum of n + m is greater than zero, and where the aromatic ring may additionally be polycyclic.

8. In an aqueous acidic plating bath for the preparation of an electrodeposit which contains 15% to 70% iron; at least one metal selected from the group consisting of nickel and cobalt or; binary or ternary alloys of iron and of the metals selected from nickel and cobalt; the improvement comprising the presence of at least one complexing compound consisting of a poly-substituted aryl compound containing at least one carboxylic acid group defined as —COOH, another substituent independently selected from hydroxy or carboxy, and one or more substituents independently selected from sulfo, or sulfoalkyl groups.

9. In a composition for the preparation of an electrodeposit which contains 15% to 70% iron and at least one metal selected from the group consisting of nickel and cobalt; which comprises an aqueous acidic electroplating solution containing iron compounds and at least one member selected from the group consisting of nickel compounds and cobalt compounds providing nickel, cobalt and iron ions for electrodepositing nickel-iron alloys, cobalt-iron alloys or nickel-iron-cobalt alloys; the improvement comprising the presence of a complexing agent of the formula:

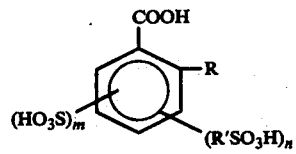

where R is independently hydroxy or carboxy, R′ is an alkylene group of 1–8 carbon atoms, and n and m are independently integers 0, 1 or 2 and the sum of n + m is greater than zero, and where the aromatic ring may additionally be polycyclic.

10. The composition of claim 9 wherein said complexing agent is 4-sulfosalicylic acid.

11. The composition of claim 9 wherein said complexing agent is 5-sulfosalicylic acid.

12. The composition of claim 9 wherein said complexing agent is 3,5-disulfo-2-hydroxybenzoic acid.

13. The composition of claim 9 wherein said complexing agent is sulfophthalic acid.

14. The composition of claim 9 wherein said complexing agent is 5-(3-sulfopropyl)-2-hydroxybenzoic acid.

* * * * *